US005302964A

United States Patent [19]

Lewins

[11] Patent Number: 5,302,964

[45] Date of Patent: Apr. 12, 1994

[54] HEADS-UP DISPLAY (HUD) INCORPORATING CATHODE-RAY TUBE IMAGE GENERATOR WITH DIGITAL LOOK-UP TABLE FOR DISTORTION CORRECTION

[75] Inventor: Lloyd J. Lewins, Marina Del Rey, Calif.

[73] Assignee: Hughes Aircraft Company, Los Angeles, Calif.

[21] Appl. No.: 951,077

[22] Filed: Sep. 25, 1992

[51] Int. Cl.[5] ..... G09G 1/04

[52] U.S. Cl. ..... 345/7; 345/14; 345/16

[58] Field of Search ..... 340/705, 736, 739, 720, 340/723, 732, 980; 359/629, 630; 345/14, 16, 7

[56] References Cited

U.S. PATENT DOCUMENTS

| | | | |
|---|---|---|---|
| 3,422,306 | 1/1969 | Gray | 315/371 |
| 4,507,656 | 3/1985 | Morey et al. | 340/736 |
| 4,632,508 | 12/1986 | Connelly | 340/705 |
| 4,831,366 | 5/1989 | Iino | 340/705 |

*Primary Examiner*—Richard Hjerpe

*Attorney, Agent, or Firm*—Terje Gudmestad; Wanda K. Denson-Low

[57] ABSTRACT

A heads-up display (50) for an aircraft includes a digital image generator (52), a cathode ray tube (CRT) (54) and an optical system (56) which projects an image (58) formed on the CRT screen (54*a*) indicating the status of the aircraft operation onto a holographic mirror combiner (60) at a slant angle. The combiner (60) is transparent to the pilot's direct view through the aircraft windshield, but produces a reflected image of the CRT screen (54*a*) which is superimposed on the direct view. Pincushion distortion in the CRT (54) and geometric distortion caused by the slant projection angle are corrected by a digital look-up table memory (82, 84) which alters the initially orthogonal CRT horizontal and vertical deflection signals (Vh,Vv) in a manner which is the inverse of the distortion such that the image (58) on the combiner (60) as viewed by the pilot appears undistorted. The size of the look-up table memory (82,84) is greatly reduced by making approximations based on analysis of the mathematical functions which define the distortion.

16 Claims, 4 Drawing Sheets

HEADS-UP DISPLAY (HUD) INCORPORATING CATHODE-RAY TUBE IMAGE GENERATOR WITH DIGITAL LOOK-UP TABLE FOR DISTORTION CORRECTION

BACKGROUND OF THE INVENTION

1. Field of the Invention

The present invention generally relates to the art of cathode ray tube (CRT) displays, and more specifically to a heads-up display (HUD) f or an aircraft including a CRT image generator and a digital look-up table memory which corrects for image distortion in the display.

2. Description of the Related Art

HUDs provide a pilot with information relating to the f light status of his or her aircraft superimposed on a direct visual view through the windshield. The pilot is freed from having to constantly shift sight from the windshield to dials in the cockpit in the conventional manner. This capability can provide a crucial advantage during high speed flight maneuvers, and during take-offs and landings in which conditions can deteriorate rapidly.

As illustrated in FIG. 1, a typical HUD 10 includes a holographic mirror combiner 12 which is built into a pilot's helmet, mounted between a pilot's head 14 and an aircraft front windshield 16 as shown or incorporated directly into a windshield. The flight information image is generated by a system electronic unit 18 to form an image on a screen of a CRT 20 which is projected by an optical system 22 onto the combiner 12 at a slant angle.

The combiner 12 is transparent to the pilot's view through the windshield 16 as indicated by arrows 24, but reflects the image from the screen of the CRT 20 such that it is visible by the pilot superimposed on the direct view. The CRT image can be a radar display generated in a raster pattern, or an information display which may be generated in a raster pattern but is more preferably generated in a stroke pattern.

An exemplary HUD information image 26 is illustrated in FIG. 2, and includes symbols designating roll angle 28, cross track 30, aircraft waterline 32, pitch limits 34, horizon 36, course 38, heading 40, glide slope 42, runway outline 44, altitude 46 and airspeed 48.

CRTs for use in HuDs, as well as other avionic displays, must have flat screens. The image for the HUD display 26 is generated by the electronic unit 18 in an orthogonal raster or stroke pattern to form a visual image on the screen of the CRT 20. However, if no corrective means are provided, the image as projected from the CRT 20 onto the combiner 12 and viewed by the pilot will be distorted. This is unacceptable in applications in which the CRT image must be superimposed accurately onto the direct view.

The distortion inherent in the HUD 10 is caused by several different sources. Due to non-linearity in the magnetic or electrostatic deflection of the electron beam in the CRT 20, an image consisting of orthogonal lines as illustrated in FIG. 3 will be subjected to "pincushion" distortion in which the lines curve toward the center as illustrated in FIG. 4.

Another source of distortion is caused by the slant angle at which the CRT image is projected by the optical system 22 onto the combiner 12, as well as aberrations in the optical system 22 itself. This is known as "geometric" distortion. Assuming that the image is projected onto the combiner 12 from above, the image will appear as curved upwardly and increasing in size in the downward direction as illustrated in FIG. 5.

Certain types of distortion in CRT based displays can be corrected as disclosed in U.S. Pat. No. 3,422,306, entitled "DISTORTION CORRECTION CIRCUITRY", issued Jan. 14, 1969 to S. Gray. Uncorrected analog deflection signals are predistorted in an inverse zaanner to the distortion caused by the CRT to produce corrected analog deflection signals which, when applied to the deflection amplifiers of the CRT, cause the CRT image to be free of pincushion and non-linearity distortion.

The circuitry for predistorting the deflection signals includes a complicated arrangement of analog multipliers, squarers, operational amplifiers and discrete components. Analog systems of this type have inherent accuracy and thermal drift problems, and are expensive and difficult to manufacture. The systems are calibrated and adjusted using analog potentiometers, requiring constant skilled maintenance. In addition, it is extremely difficult to provide a built-in test (BIT) capability in an analog system of this type.

SUMMARY OF THE INVENTION

A heads-up display (HUD) for an aircraft embodying the present invention includes a digital image generator, a cathode ray tube (CRT) and an optical system which projects the image formed on the CRT screen indicating the status of the aircraft operation onto a holographic mirror combiner at a slant angle. The combiner is transparent to the pilot's direct view through the aircraft windshield, but produces a reflected image of the CRT screen which is superimposed on the direct view.

Pincushion distortion in the CRT and geometric distortion caused by the slant projection angle are corrected by a digital look-up table -memory which is accessed by both the horizontal and vertical coordinates of the image and alter the initial orthogonal horizontal and vertical CRT deflection signals in a manner which is the inverse of the distortion such that image on the combiner as viewed by the pilot appears undistorted.

The size of the look-up table memory is greatly reduced by making approxiraations based on analysis of the mathematical functions which define the distortion. Typically, the correction functions in a particular axis (horizontal or vertical) are less dependent on the input from the opposite axis than on the input from their own axis. This enables the number of bits of the opposite axis input to be less than that of the same axis input and still produce a satisfactory image distortion correction.

In addition, the rate of change of the corrected vertical deflection signals with respect to the initial orthogonal vertical deflection signals is approximately unity. This enables the memory section for the vertical correction to be addressed by only the higher order bits of the vertical input, with the uncorrected lower order bits being added to the output of the vertical memory section.

The digital correction in combination with the reduced memory requirement enable the present HUD and CRT display to be manufactured easily at low cost, with reduced component count and space requirements, improved reliability and testability and built-in test (BIT) capability.

These and other features and advantages of the present invention will be apparent to those skilled in the art from the following detailed description, taken together with the accompanying drawings, in which like reference numerals refer to like parts.

DESCRIPTION OF THE DRAWINGS

FIG. I is a diagram illustrating a typical heads-up display (HUD).

DETAILED DESCRIPTION OF THE INVENTION

Figure 1:
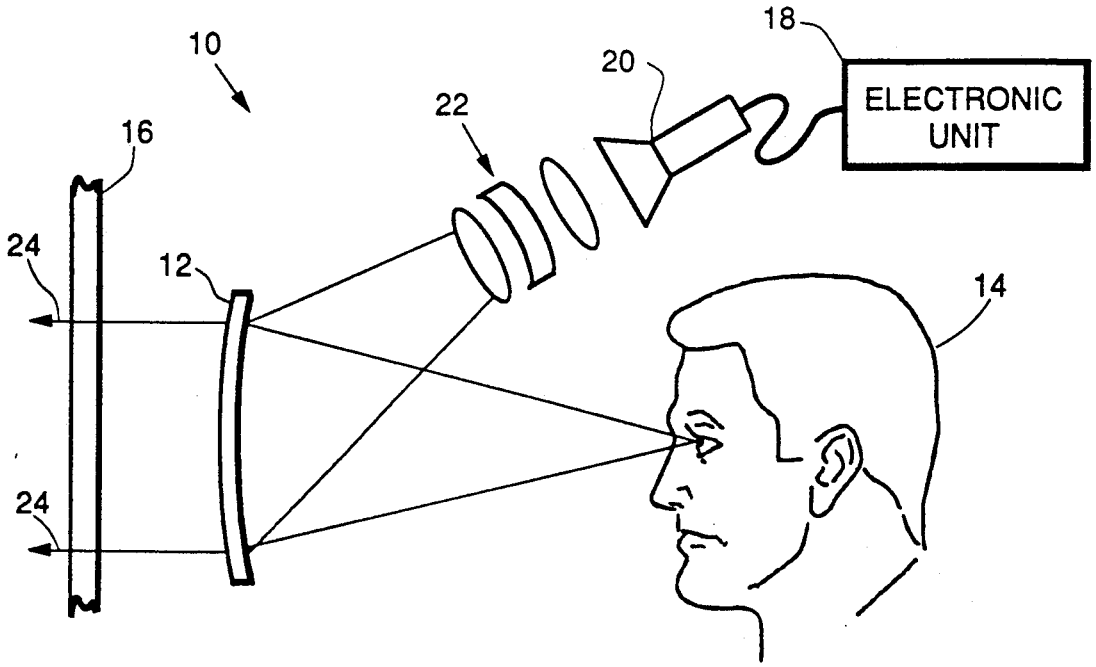
FIG. 1. ( PRIOR ART )
Figure 6:
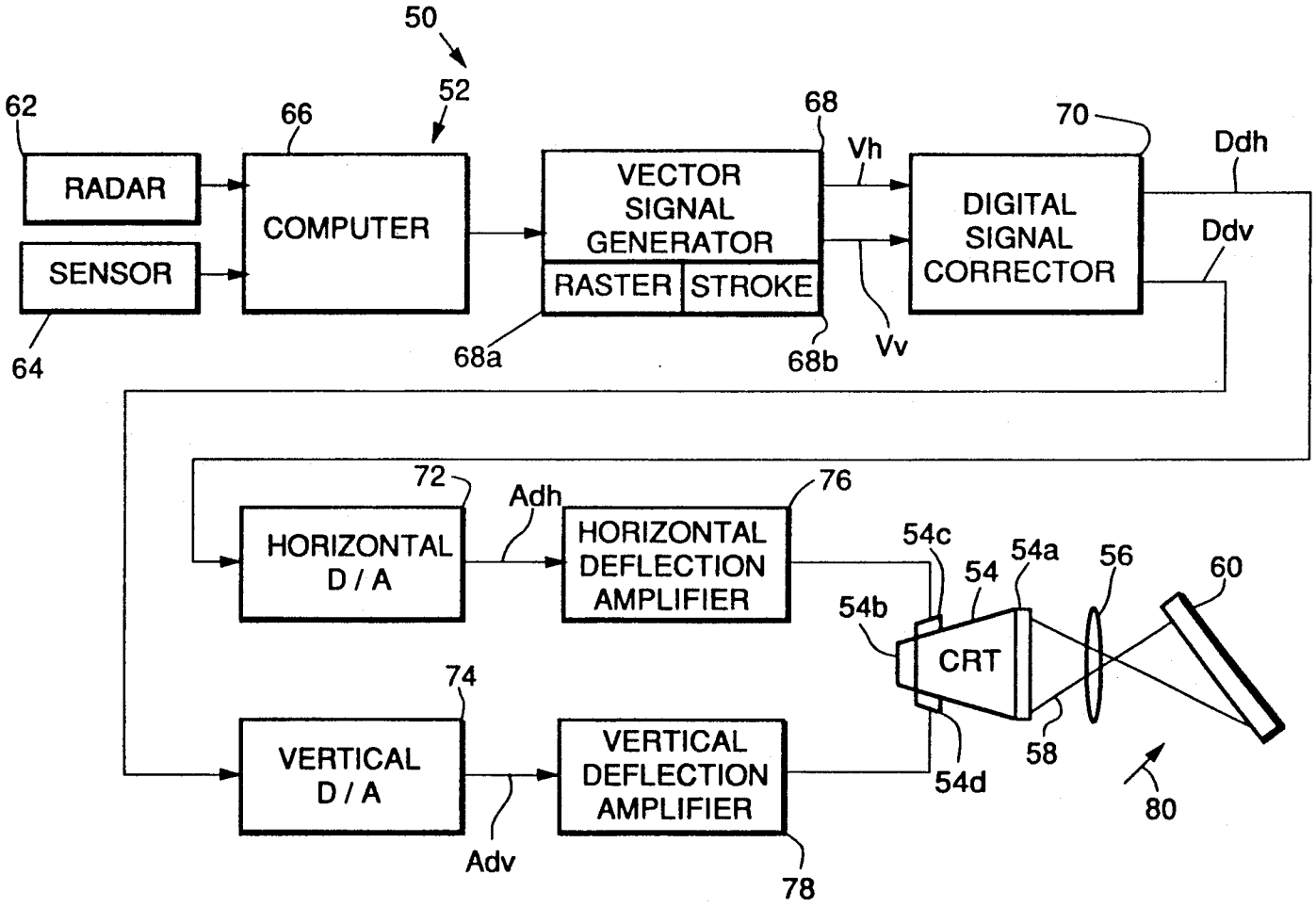
FIG. 6 is a block diagram illustrating a HUD embodying the present invention.

As illustrated in FIG. 6, a heads-up display (HUD) 50 embodying the present invention includes a system electronic unit 52 which generates images for display on a flat screen 54*a* of a cathode ray tube (CRT) 54. An optical system 56 projects an image 58 of the screen 54*a* onto a holographic mirror combiner 60 in the manner described above with reference to FIG. 1.

Figure 2:
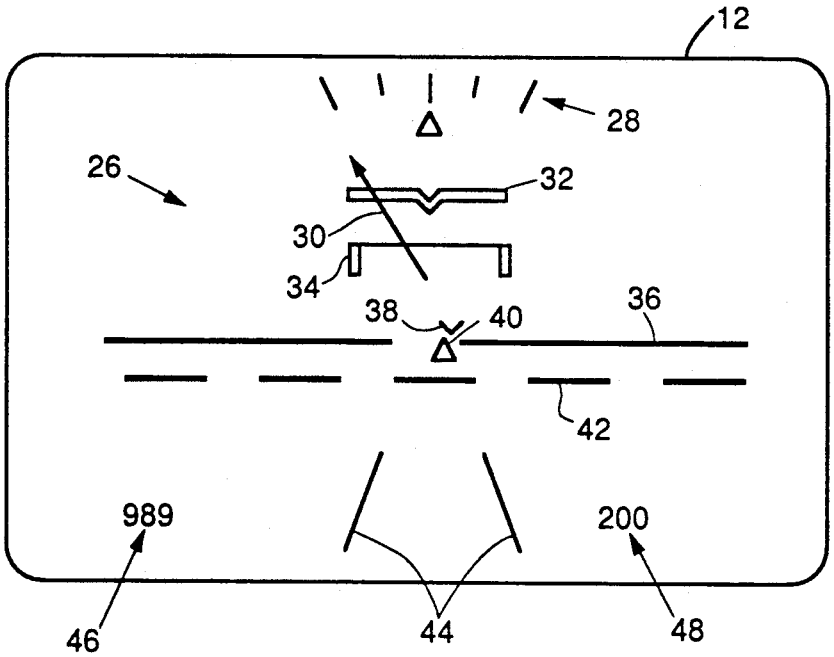
FIG. 2. ( PRIOR ART )
FIG. 2, is a diagram illustrating an information image produced by the system of FIG. 1.
Figure 3:
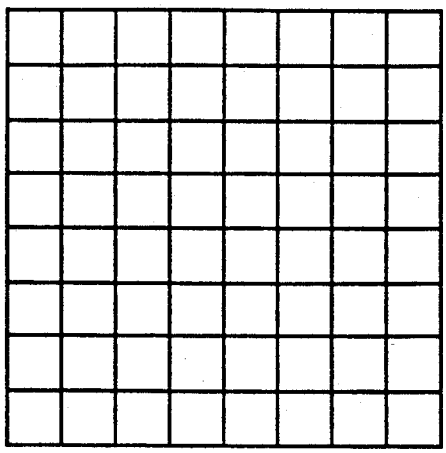
FIG. 3. ( PRIOR ART )
FIG. 3 is a diagram illustrating an undistorted image consisting orthogonal lines.

The electronic unit 52 includes a radar unit 62 which generates, for example, a radar image of the ground in front of and below an aircraft to aid in low visibility landings. Sensors 64 provide aircraft flight status information including airspeed, altitude, etc. as illustrated in FIG. 2. The data generated by the radar unit 62 and sensors 64 is fed to a digital processing unit which may be a general purpose digital computer 66.

The computer 66 feeds data to a vector signal generator 68 including a raster image generator Bection 68*a* for generating a radar image in a raster pattern and a stroke image generator section 68*b* for generating an information image in a stroke pattern. The vector signal generator 68 generates digital horizontal and vertical vector signals Vh and Vv respectively and feeds them to a digital signal corrector unit 70.

The vector signals Vh and Vv are selected f rom an orthogonal array in various combinations to form an orthogonal image such as illustrated in FIG. 2. The corrector unit 70 receives the signals Vh and Vv and produces digital horizontal and vertical deflection signals Ddh and Ddv respectively in response thereto which are corrected for inherent distortions in the HUD 50. Horizontal and vertical digital-to-analog converters (D/A) 72 and 74 receive the signals Ddh and Ddv and generate analog horizontal and vertical deflection signals Adh and Adv respectively in response thereto.

The CRT 54 further includes an electron gun 54*b* for emitting a beam of electrons toward the screen 54*a*, and horizontal and vertical deflectors 54*c* and 54*d* for laterally deflecting the electron beam in response to the signals Adh and Adv from the converters 72 and 74 after amplification by horizontal and vertical deflection amplifiers 76 and 78 respectively. The deflector 54*c* and 54*d* may be magnetic coils or electrostatic plates.

The computer 66 is preferably programmed to alternatingly switch between the radar raster image and the information stroke image such that both appear on the combiner 60 superimposed on the view through the aircraft windshield. The raster image consists of a continuously generated pattern of horizontal lines in which a bright point is produced by unblanking the electron beam and a dark point is produced by blanking the electron beam. The stroke image is generated by moving the electron beam between only the bright points of the image. The beam is unblanked to illuminate the bright points and blanked during movement.

The corrector unit 70 is configured such that an image on the combiner 60 as viewed f rom a predetermined angle indicated by an arrow 80 will appear undistorted. The vector signal generator 68 generates a vector image consisting of the horizontal and vertical vector signals Vh and Vv which are selected in combinations corresponding to the image from an orthogonal array. The corrector unit 70 predistorts the digital horizontal and vertical deflection signals Ddh and Ddv in a manner which is the inverse of the inherent distortion in the HUD 50 such that the image on the combiner 60 appears the same as the orthogonal image Vh, Vv generated by the vector signal generator 68. In other words, the corrector unit 70 generates distortion which reverses the inherent distortion in the HUD 50.

The digital deflection signals Ddh and Ddv differ from the vector signals Vh and Vv in a predetermined manner which depends on the types of distortion inherent in the HUD 50. Ddh is related to Vh and Vv by a horizontal correction function fch such that Ddh=fch (Vh, Vv), whereas Ddv is related to Vh and Vv by a vertical correction function fcv such that Ddv=fcv(Vh,Vv).

Figure 4:
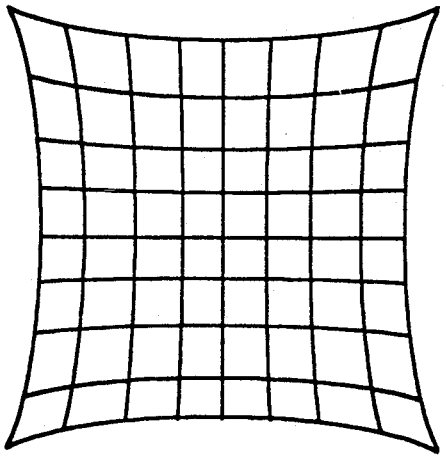
FIG. 4. ( PRIOR ART )
FIG. 4 similar to FIG. 3, but illustrates the image after being subjected to "pincushion" distortion.

For example, horizontal and vertical correction functions $f_{pinh}$ and fpinv respectively for pincushion distortion as illustrated in FIG. 4 can be represented by quadratic equations of the form $$f_{pinh}(X) = X\left[1 - \frac{X^2 + Y^2}{k}\right] \text{and}$$

$$f_{pinv}(Y) = Y\left[1 - \frac{X^2 + Y^2}{k}\right]$$

where X and Y are the numerical values of the vector signals Vh and Vv respectively, and k is a constant which depends on the beam deflection angle in the CRT 54.

Figure 5:
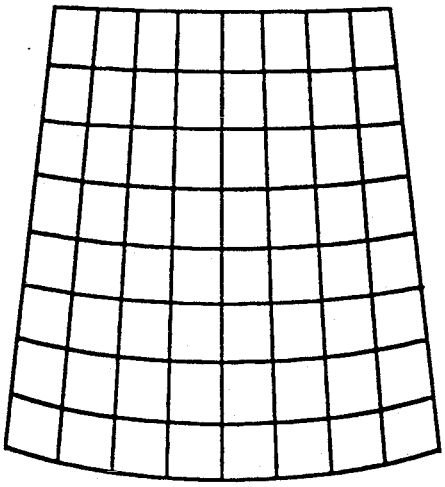
FIG. 5. ( PRIOR ART )
FIG. 5 is also similar to FIG. 3, but illustrates the image after being subjected to "geometric" distortion.

Horizontal and vertical correction functions $f_{polyh}(X)$ and $f_{polyv}(Y)$ respectively for geometric distortion as illustrated in FIG. 5 can be represented by polynomial equations of the form $$f_{polyh}(X)=J_1X+J_2XY+J_3X^3+j_4XY^2+J_5XY^3+J_6X^3Y+j_7Y+j_8X^2+j_9Y^2+j_{10}Y^3+j_{11}X^2Y+j_{12}X^4 \text{and}$$

$$f_{polyv}(Y)=k_1+k_2y+k_3X^2+k_4y^2+k_5y^3+k_6X^2Y+k_7X^2Y^2+k_8Y^4+k_9X+K_{10}XY+k_{11}X^3+k_{12}XY^2$$

where $j_1$ and $j_{12}$ and $k_1$ to $k_{12}$ are constants which depend on the slant projection angle of the image 58, focal length of the optical system 56, etc.

The horizontal and vertical correction functions fch and fcv are calculated as combinations of the correction functions for the individual types of distortion by mathematical functional composition. In the exemplary case of pincushion and geometric distortion, $fch = f_{pinh}$ O $f_{polyh}$ and $fcv = f_{pinv}$ O $f_{polyvl}$, where "o" is the symbol for functional composition.

Figure 7:
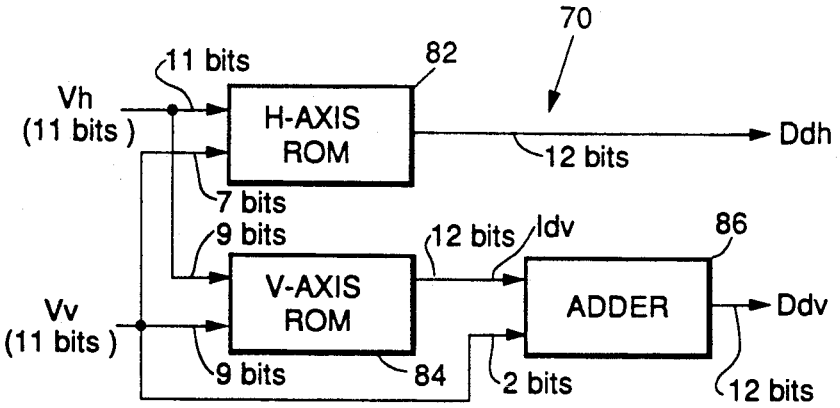
FIG. 7 is a block diagram illustrating a memory unit of the HUD of FIG. 6.

As illustrated in FIG. 7, the corrector unit 70 includes a horizontal or H-axis look-up table memory 82 and a vertical or V-axis look-up table memory 84. The memories 82 and 84 may be read-only memories (ROM) as illustrated, or may alternatively be random access memories (RAM). In either case, the digital horizontal deflection signals Ddh are stored in memory cells or locations in the memory 82 which are addressed by both of the vector signals Vh and VV.

More specifically, the memory 82 includes an orthogonal array of locations which are addressed by two dimensional orthogonal inputs consisting of the vector signals Vh and Vv. Each discrete combination of Vh and Vv addresses a single location in the memory 82 in which a respective value of Ddh is stored.

It is within the scope of the invention to configure the memory 84 in the same manner as the memory 82, and apply all 11 bits of the vector signals Vh and Vv to the address inputs of both memories 82 and 84. In this case, the memories 82 and 84 in combination will require two 11 bit address inputs, and two 12 bit words stored at each address. The capacity of the raemories 82 and 84 in combination will be approximately 96 megabits.

In order to reduce the required capacity of the memories 82 and 84 and thereby the cost and size of the HUD 50, and also increase the speed of operation, approximations are made based on the analysis of the mathematical functions which represent the distortion and correction. This enables the numbers of bits of the address inputs to the memories 82 and 84 to be reduced while still providing acceptable distortion correction.

For example, the correction functions in a particular axis (horizontal or vertical) are generally less dependent on the input from the opposite axis than on the input from their own axis. This enables the number of bits of the opposite axis input to be less than that of the same axis input and still produce a satisfactory image correction. More specifically, the digital horizontal deflection signals Ddh are more dependent on the respective horizontal vector signals Vh than on the vertical vector signals vv, and the digital vertical deflection signals Ddv are more dependent on the vertical vector signals Vv than on the horizontal vector signals Vh.

This can be analyzed mathematically by calculating the maximum values (max) of the partial derivatives of the digital horizontal and vertical deflection signals Ddh and Ddv with respect to the vector signals Vh and Vv. In this case, $\max|\partial Ddh/\partial Vh| >> \max|\partial Ddh/aVv|$ and $\max|\partial ddv/avv| >> \max|\partial Ddv/\partial Vh|$.

As an example of this type of approximation, it will be assumed that the vector signals Vh and Vd for the raster image require 9 binary bits each to provide satisfactory resolution and distortion correction. The vector signals Vh and Vv for the stroke image require the higher resolution provided by 11 bits. The digital deflection signals Ddh and Ddv must have 12 bits each to provide the necessary resolution and distortion correction required by the raster image.

By numerical simulation and/or empirical investigation based on the above analysis, it is determined, although all 11 bits of the horizontal vector signal Vh are required to address the memory 82, that satisfactory correction of distortion will occur if only the 7 most significant bits of the vertical vector signal Vv are utilized for addressing the memory 82. This is accomplished by configuring the memory 82 as an 11×7 array, and connecting only the 7 most significant bits of the Vv output of the vector signal generator 68 to the Vv address inputs of the memory 82. In a similar manner, it is determined that the vertical memory 84 can be addressed using only the 9 most significant bits of the horizontal vector signal Vh.

The memory required for distortion correction can be further reduced by examining the rates of change of the digital deflection signals with respect to the vector signals. Mathematically, this relationship can be analyzed by calculating the partial derivatives of the digital deflection signals with respect to the vector signals in the image area. If a calculated partial derivative is unity, the overall gain of the loop-up table in the axis in which the partial derivative is taken is also unity.

If these rates of change (partial derivatives) are sufficiently close to unity, only a selected number of the most significant bits of the vector signal can be used to generate coarse digital deflection signals, and the remaining least significant bits are then added to the coarse digital deflection signal. In the present example, $\partial Ddv/\partial Vv \simeq 1$, indicating that the rate of change of the digital vertical deflection signals Ddv with respect to the vertical vector signals vv is approximately unity.

As illustrated in FIG. 7, only the 9 most significant bits of the vertical vector signal Vv are applied to address the memory 84. In this case, the memory 84 stores coarse or intermediate digital vertical deflection signals Idv which are corrected for vertical distortion based on the applied bits of the vector signals Vh and Vv. Although the signals Idv consist of 12 bits, they are based on 9 bit rather than 11 bit vertical resolution, which can cause vertical displacement of image points from their proper positions and result in the formation of erroneous patterns in a manner known as "aliasing".

Due to the approximately unity gain of the look-up table in the vertical direction, satisfactory vertical resolution can be restored by applying the 2 least significant bits of the vertical vector signal Vv to the two least significant bit lines of one input of a 12 bit adder 86. The entire 12 bits of the intermediate vertical deflection signal Idv are applied to another input of the adder 86 such that the least significant 2 bits of the signal Vv are added to the signal Idv to produce the digital vertical deflection signal Ddv. In this manner, the resolution which was lost by approximating the Vv signal input to the memory 84 by 9 rather than 11 bits is restored to a satisfactory extent.

Figure 8A:
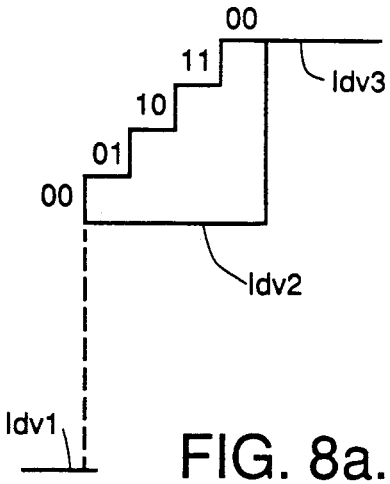
FIGS. 8*a* to 8*c* are diagrams illustrating the operation of the memory unit of FIG. 7.

The operation of the memory 84 and adder 86 is illustrated in FIG. 8*a*. It is assumed that the intermediate deflection signal Idv has a first value Idv1, a second value Idv2 which can be much higher (as illustrated) or lower than the value Idv1, and a third value Idv3 which is one incremental value higher than Idv2 with the vertical vector signal Vv approximated by 9 bits. The incremental values provided by the 2 least significant bits of the signal Vv as applied to the adder 86 are designated as binary 00, 01, 10 and 11 respectively.

It will be seen that, due to the unity gain of the vertical correction function in the look-up table, the signal Idv2 plus four incremental steps of the least 2 significant bits of the signal Vv is equal to the signal Idv3. Since the increment between Idv2 and Idv3 is accurately spanned by four incremental steps of the 2 bit Vv input to the adder 86, the increments 00, 01, 10 and 11 will be proportionally correct. Thus, the vertical distortion correction can be provided using a 9 bit approximation of the vertical vector signal Vv, and the missing resolution restored by adding the uncorrected 2 least significant bits of the signal Vv to the corrected intermediate signal Idv.

Figure 8B:
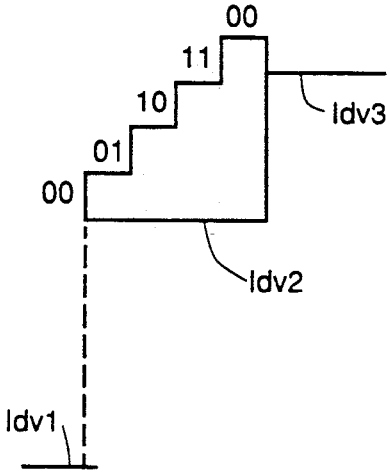
Figure 8C:
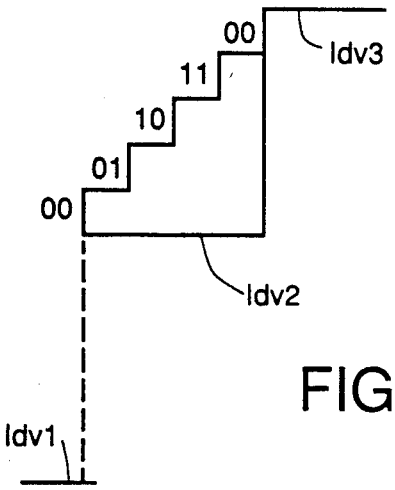

For comparison, FIG. 8*b* illustrates the situation in which the rate of change of the vertical correction is greater than that of the vertical vector signal Vv. In this case, addition of four incremental steps of the least 2 significant bits of the signal Vv to the signal Idv2 produces a value which is greater than Idv3. FIG. 8*c* illustrates the situation in which the rate of change of the vertical correction is smaller than that of the vertical vector signal Vv. In this case, addition of four as incremental steps of the least 2 significant bits of the signal Vv to the signal Idv2 produces a value which is smaller than Idv3.

Although the approximation utilizing the adder 86 has been described and illustrated for only the vertical axis, it may also be applied to the horizontal axis.

The two approximation methods as illustrated in FIG. 7 enable the combined size of the memories 82 and 84 to be reduced from 96 Megabits to 6 megabits, with the only increase in parts count being the addition of one 12 bit adder 86. The memories 82 and 84 can be embodied in practice by six commercially available memory chips, each having 262,144 (256K) addressable locations, with 4 bits stored in each location.

It is further within the scope of the invention to embody the memories 82 and 84 as RAMs rather than ROMS, and download the signals Ddh and Ddv into the memories 82 and 84 prior to operation of the HUD 50. In this case, the signals Ddh and Ddv can be changed dynamically to enable precise calibration and tuning of the correction functions for the particular combination of CRT 54 and optical system 56 being used.

It is also possible to change the signals Ddh and Ddv to perform image scaling, translation and rotation. A built-in test (BIT) capability can be easily provided using RAMS, as well as the ability to bypass the distortion correction if desired for testing and other purposes.

While several illustrative embodiments of the invention have been shown and described, numerous variations and alternate embodiments will occur to those skilled in the art, without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

I claim:

1. A display apparatus, comprising:

a cathode ray tube including a cathodoluminescent screen, beam generating means for emitting an electron beam toward the screen and deflection means for laterally deflecting said beam in accordance with applied analog horizontal and vertical deflection signals;

vector signal generator means for generating digital horizontal and vertical vector signals selected from an orthogonal array;

memory means for storing digital horizontal and vertical deflection signals in an orthogonal array of locations which are addressed by said horizontal and vertical vector signals respectively; and digital-to-analog converter means for generating said analog horizontal and vertical deflection signals in response to said digital horizontal and vertical deflection signals which are output from the memory means in response to addressing of said locations by said horizontal and vertical vector signals respectively;

said digital horizontal and vertical deflection signals differing from said horizontal and vertical vector signals in a manner which is predetermined to reverse inherent distortion in the display apparatus such that an image formed on the screen by said beam in response to selected combinations of said horizontal and vertical vector signals generated by the vector signal generator means as viewed from a predetermined position appears substantially orthogonal; in which the rate of change of said digital vertical deflection signals with respect to said respective vertical vector signals is approximately unity;

said vertical vector signals each comprise a predetermined number of most significant bits and a predetermined number of least significant bits;

the memory means comprises a vertical memory section for storing digital intermediate vertical signals in locations which are addressed by said horizontal vector signals and are also addressed by and differ from said most significant bits of said vertical vector signals in said predetermined manner; and the apparatus further comprises adder means for adding said intermediate vertical signals to said least significant bits of said respective vertical vector signals.

2. An apparatus as in claim 1, in which:

the screen is flat;

said inherent distortion comprises pincushion distortion created in the cathode ray tube; and said digital horizontal and vertical deflection signals differ from said horizontal and vertical vector signals in a manner which is predetermined to create distortion which is substantially the inverse of said pincushion distortion.

3. An apparatus as in claim 1, further comprising:

a surface; and optical means for projecting said image from the screen onto the surface, in which:

said inherent distortion comprises geometric distortion created by the optical means; and said digital horizontal and vertical deflection signals differ from said horizontal and vertical vector signals in a manner which is predetermined to create distortion which is substantially the inverse of said geometric distortion.

4. An apparatus as in claim 1, in which the memory means is configured such that said digital horizontal and vertical deflection signals have a larger number of bits than said horizontal and vertical vector signals.

5. A display apparatus, comprising:

a cathode ray tube including a cathodoluminescent screen, beam generating means for emitting an electron beam toward the screen and deflection means for laterally deflecting said beam in accordance with applied analog horizontal and vertical deflection signals;

vector signal generator means for generating digital horizontal and vertical vector signals selected from an orthognal array;

memory means for storing digital horizontal and vertical deflection signals in an orthogonal array of locations which are addressed by said horizontal and vertical vector signals respectively; and digital-to-analog converter means for generating said analog horizontal and vertical deflection signals in response to said digital horizontal and vertical deflection signals which are output from the memory means in response to addressing of said locations by said horizontal and vertical vector signals respectively;

said digital horizontal and vertical deflection signals differing from said horizontal and vertical vector signals in a manner which is predetermined to reverse inherent distortion in the display apparatus such that an image formed on the screen by said beam in response to selected combinations of said horizontal and vertical vector signals generated by the vector signal generator means as viewed from a predetermined position appears substantially orthogonal; in which:

said digital horizontal deflection signals are dependent on said respective horizontal vector signals and said respective vertical vector signals; and the memory means is configured such that said locations for storing said digital horizontal deflection signals are addressed by a larger number of bits of said horizontal vector signals than of said vertical vector signals.

6. A heads-up display (HUD), comprising:

a cathode ray tube including a cathodoluminescent screen, beam generating means for emitting an electron beam toward the screen and deflection means for laterally deflecting said beam in accordance with applied analog horizontal and vertical deflection signals;

a combiner;

optical means for projecting an image formed on the screen by said beam onto the combiner;

vector signal generator means for generating digital horizontal and vertical vector signals corresponding to said image which are selected from an orthogonal array;

memory means for storing digital horizontal and vertical deflection signals in an orthogonal array of locations which are addressed by said horizontal and vertical vector signals respectively; and digital-to-analog converter means for generating said analog horizontal and vertical deflection signals in response to said digital horizontal and vertical deflection signals which are output from the memory means in response to addressing of said locations by said horizontal and vertical vector signals respectively;

said digital horizontal and vertical deflection signals differing from said horizontal and vertical vector signals in a manner which is predetermined to reverse inherent distortion in the display such that said image as projected onto the combiner by the optical means and viewed from a predetermined position appears substantially orthogonal; in which the rate of change of said digital vertical deflection signals with respect to said respective vertical vector signals is approximately unity;

said vertical vector signals comprise a predetermined number of most significant bits and a predetermined number of least significant bits;

the memory means comprises a vertical memory section for storing intermediate vertical signals in locations which are addressed by said horizontal vector signals and are also addressed by and differ from said most significant bits of said vertical vector signals in said predetermined manner; and the HUD further comprises adder means for adding said intermediate vertical signals to said least significant bits of said vertical vector signals respectively.

7. A HUD as in claim 6, in which:

said inherent distortion comprises pincushion distortion created in the cathode ray tube; and said digital horizontal and vertical deflection signals differ from said horizontal and vertical vector signals in a manner which is predetermined to create distortion which is substantially the inverse of said pincushion distortion.

8. A HUD as in claim 6, in which:

the optical means projects said image from the screen onto the combiner at a slant angle to create geometric distortion; and said digital horizontal and vertical deflection signals differ from said horizontal and vertical vector signals in a manner which is predetermined to create distortion which is substantially the inverse of said geometric distortion.

9. A HUD as in claim 6, in which the vector signal generator means comprises rester image generator means and stroke image generator means for generating said horizontal and vertical vector signals in such a manner as to alternatingly form raster and stroke images on the screen respectively.

10. A HUD as in claim 9, in which the stroke image generator means generates said horizontal and vertical vector signals to form said stroke image with a larger number of bits than the raster image generator means generates said horizontal and vertical vector signals to form said raster image.

11. A HUD as in claim 6, in which the memory means is configured such that said digital horizontal and vertical deflection signals have a larger number of bits than said horizontal and vertical vector signals.

12. A heads-up display (HUD), comprising:

a cathode ray tube including a cathodoluminescent screen, beam generating means for emitting an electron beam toward the screen and deflection means for laterally deflecting said beam in accordance with applied analog horizontal and vertical deflection signals;

a combiner;

optical means for projecting an image formed on the screen by said beam onto the combiner;

vector signal generator means for generating digital horizontal and vertical vector signals corresponding to said image which are selected from an orthogonal array;

memory means for storing digital horizontal and vertical deflection signals in an orthogonal array of locations which are addressed by said horizontal and vertical vector signals respectively; and digital-to-analog converter means for generating said analog horizontal and vertical deflection signals in response to said digital horizontal and vertical deflection signals which are output from the memory means in response to addressing of said locations by said horizontal and vertical vector signals respectively;

said digital horizontal and vertical deflection signals differing from said horizontal and vertical vector signals in a manner which is predetermined to reverse inherent distortion in the display such that said image as projected onto the combiner by the optical means and viewed from a predetermined position appears substantially orthogonal; in which:

said digital horizontal deflection signals are dependent on said respective horizontal vector signals and said respective vertical vector signals; and the memory means is configured such that said locations for storing said digital horizontal deflection signals are addressed by a larger number of bits of said horizontal vector signals than of said vertical vector signals.

13. A display apparatus, comprising:

a cathode ray tube including a cathodoluminescent screen, beam generating means for emitting an electron beam toward the screen and deflection means for laterally deflecting said beam in accordance with applied orthogonal analog first axis and second axis deflection signals;

vector signal generator means for generating orthogonal digital first axis and second axis vector signals selected from an orthogonal array;

memory means for storing orthogonal digital first axis and second axis deflection signals in an orthogonal array of locations which are addressed by said first axis and second axis vector signals respectively; and digital-to-analog converter means for generating said analog first axis and second axis deflection signals in response to said digital first axis and second axis deflection signals which are output from the memory means in response to addressing of said locations by said first axis and second axis vector signals respectively;

said digital first axis and second axis deflection signals differing from said first axis and second axis vector signals in a manner which is predetermined to reverse inherent distortion in the display apparatus such that an image formed on the screen by said beam in response to selected combinations of said first axis and second axis vector signals generated by the vector signal generator means as viewed from a predetermined position appears substantially orthogonal; in which the rate of change of said digital second axis deflection signals with respect to said respective second axis vector signals is approximately unity;

said second axis vector signals each comprise a predetermined number of most significant bits and a predetermined number of least significant bits;

the memory means comprises a second axis memory section for storing digital intermediate second axis signals in locations which are addressed by said first axis vector signals and are also addressed by and differ from said most significant bits of said second axis vector signals in said predetermined manner; and the apparatus further comprises adder means for adding said intermediate second axis signals to said least significant bits of said respective second axis vector signals.

14. A display apparatus, comprising:

a cathode ray tube including a cathodoluminescent screen, beam generating means for emitting an electron beam toward the screen and deflection means for laterally deflecting said beam in accordance with applied orthogonal analog first axis and second axis deflection signals;

vector signal generator means for generating orthogonal digital first axis and second axis vector signals selected from an orthogonal array;

memory means for storing orthogonal digital first axis and second axis deflection signals in an orthogonal array of locations which are addressed by said first axis and second axis vector signals respectively; and digital-to-analog converter means for generating said analog first axis and second axis deflection signals in response to said digital first axis and second axis deflection signals which are output from the memory means in response to addressing of said locations by said first axis and second axis vector signals respectively;

said digital first axis and second axis deflection signals differing from said first axis and second axis vector signals in a manner which is predetermined to reverse inherent distortion in the display apparatus such that an image formed on the screen by said beam in response to selected combinations of said first axis and second axis vector signals generated by the vector signal generator means by viewed from a predetermined position appears substantially orthogonal; in which said digital first axis deflection signals are dependent on said respective first axis vector signals and said respective second axis vector signals; and the memory means is configured such that said locations for storing said digital first axis deflection signals are addressed by a larger number of bits of said first axis vector signals than of said second axis vector signals.

15. A heads-up display (HUD), comprising:

a cathode ray tube including a cathodoluminescent screen, beam generating means for emitting an electron beam toward the screen and deflection means for laterally deflecting said beam in accordance with applied orthogonal analog first axis and second axis deflection signals;

a combiner;

optical means for projecting an image formed on the screen by said beam onto the combiner;

vector signal generator means for generating orthogonal digital first axis and second axis vector signals corresponding to said image which are selected from an orthogonal array;

memory means for storing orthogonal digital first axis and second axis deflection signals in an orthogonal array of locations which are addressed by said first axis and second axis vector signals respectively; and digital-to-analog converter means for generating said analog first axis and second axis and second axis deflection signals which are output from the memory means in response to addressing of said locations by said first axis and second axis vector signals respectively;

said digital first axis and second axis deflection signals differing from said first axis and second axis vector signals in a manner which is predetermined to reverse inherent distortion in the display apparatus such that an image formed on the screen by said beam in response to selected combinations of said first axis and second axis vector signals generated by the vector signal generator means as viewed from a predetermined position appears substantially orthogonal; in which the rate of change of said digital second axis deflection signals with respect to said respective second axis vector signals is approximately unity;

said second axis vector signals each comprise a predetermined number of most significant bits and a predetermined number of least significant bits;

the memory means comprises a second axis memory section for storing digital intermediate second axis signals in locations which are addressed by said first axis vector signals and are also addressed by and differ from said most significant bits of said second axis vector signals in said predetermined manner; and the apparatus further comprises adder means for adding said intermediate second axis signals to said least significant bits of said respective second axis vector signals.

16. A heads-up display (HUD), comprising:

a cathode ray tube including a cathodoluminescent screen, beam generating means for emitting an electron beam toward the screen and deflection means for laterally deflecting said beam in accordance with applied orthogonal analog first axis and second axis deflection signals;

a combiner;

optical means for projecting an image formed on the screen by said beam onto the combiner;

vector signal generator means for generating orthogonal digital first axis and second axis vector signals corresponding to said image selected from an orthogonal array;

memory means for storing orthogonal digital first axis and second axis deflection signals in an orthogonal array of locations which are addressed by said first axis and second axis vector signals respectively; and digital-to-analog converter means for generating said analog first axis and second axis deflection signals in response to said digital first axis and second axis deflection signals which are output from the memory means in response to addressing of said locations by said first axis and second axis vector signals respectively;

said digital first axis and second axis deflection signals differing from said first axis and second axis vector signals in a manner which is predetermined to reverse inherent distortion in the display apparatus such that an image formed on the screen by said beam in response to selected combinations of said first axis and second axis vector signals generated by the vector signal generator means as viewed from a predetermined position appears substantially orthogonal; in which said digital first axis deflection signals are dependent on said respective first axis vector signals and said respective second axis vector signals; and the memory means is configured such that said locations for storing said digital first axis deflection signals are addressed by a larger number of bits of said first axis vector signals than of said second axis vector signals.

* * * * *